US005253433A

United States Patent [19]

Frey

[11] Patent Number: 5,253,433

[45] Date of Patent: Oct. 19, 1993

[54] SELF-ALIGNING REVERSIBLE DOOR MOUNTING ARRANGEMENT FOR AN APPLIANCE

[75] Inventor: Barry J. Frey, Louisville, Ky.

[73] Assignee: General Electric Company, Louisville, Ky.

[21] Appl. No.: 364

[22] Filed: Jan. 4, 1993

[51] Int. Cl.[5] ..... F26B 11/02

[52] U.S. Cl. ..... 34/133 H; 29/401.1; 49/192; 16/235

[58] Field of Search ..... 34/133 H, 242, 91; 29/401.1; 49/192, 193, 194; 16/235, 239, 240, 241

[56] References Cited

U.S. PATENT DOCUMENTS

| | | | |
|---|---|---|---|
| 616,258 | 12/1898 | Rembold . | |
| 887,548 | 5/1908 | Trumble . | |
| 1,835,042 | 4/1930 | Hammer . | |
| 2,708,293 | 5/1955 | Sherman . | |
| 2,899,717 | 8/1959 | Billings et al. . | |
| 3,321,100 | 5/1967 | Toma . | |
| 3,538,641 | 11/1970 | Miller et al. . | |
| 4,475,266 | 10/1984 | Suska | 16/276 |
| 5,113,562 | 5/1992 | Studt | 29/401 |

*Primary Examiner*—Henry A. Bennet

*Attorney, Agent, or Firm*—H. Neil Houser; Radford M. Reams

[57] ABSTRACT

A reversible clothes dryer door mounting arrangement in which the hinge assembly attaching the door to the dryer cabinet includes at least one and preferably two leaf hinges, each having a fixed hinge leaf attached to the door and a detachable hinge leaf attached to the cabinet. Each detachable leaf has a pair of vertically disposed keyhole shaped screw holes. The reduced portion of the upper keyhole extends upwardly from the enlarged portion. The reduced portion of the lower keyhole extends downwardly from the enlarged portion. Mounting holes are provided in the cabinet front wall on both sides of the access opening, aligned to be in register with the reduced portions of the upper and lower keyhole openings. The door is mounted by partially inserting a mounting screw in the uppermost mounting hole on the selected side of the cabinet. The enlarged portion of the upper keyhole opening in the leaf is passed over the head of the mounting screw and dropped down. When the upper edge of the reduced portion of the keyhole abuts the shank of the screw, the door is aligned for insertion of the remaining mounting screws. To reverse the mounting, the door is disconnected by removing the screws attaching the detachable leaves to the cabinet and the door is inverted and reattached on the opposite side of the access opening as above described.

4 Claims, 1 Drawing Sheet fig. 1
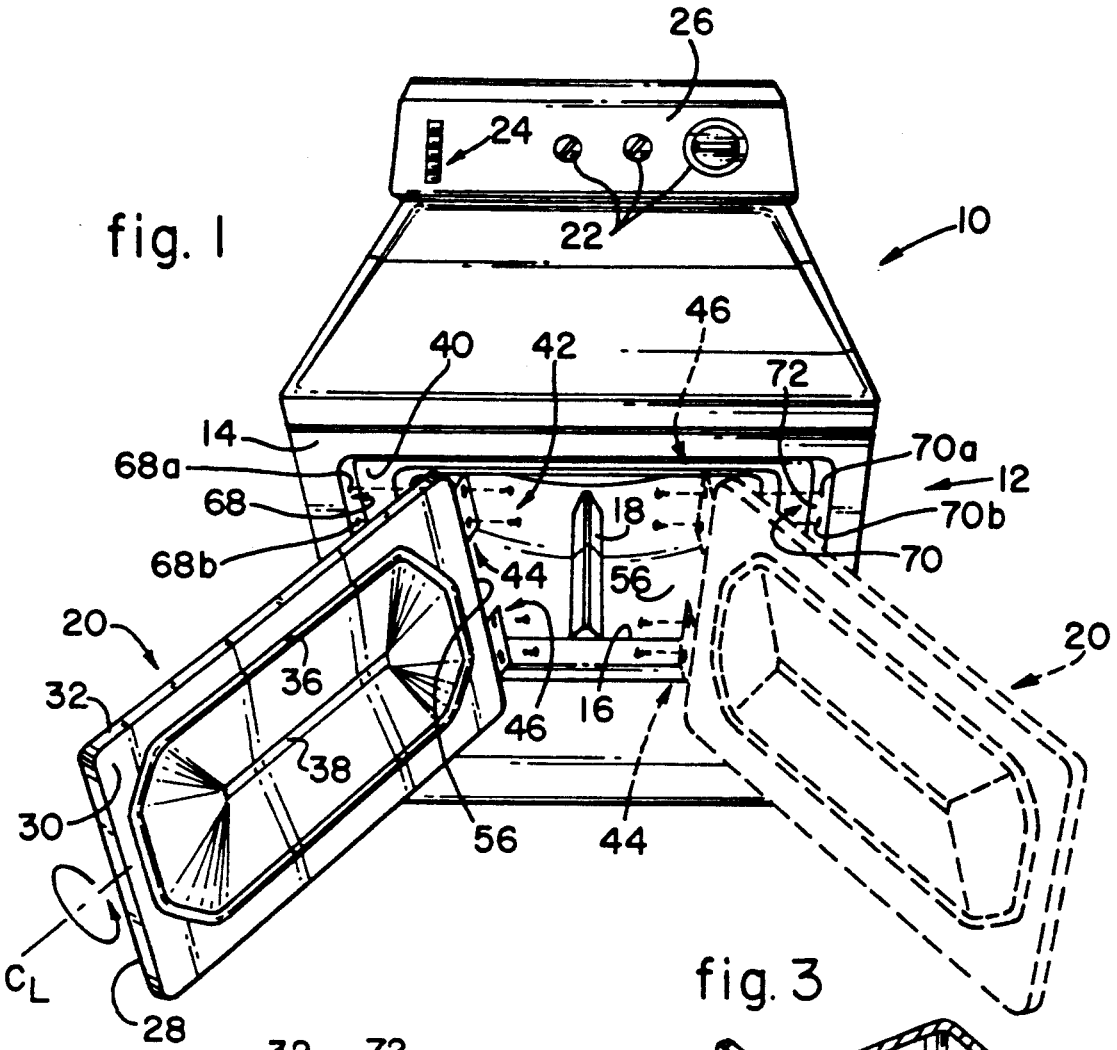
fig. 3
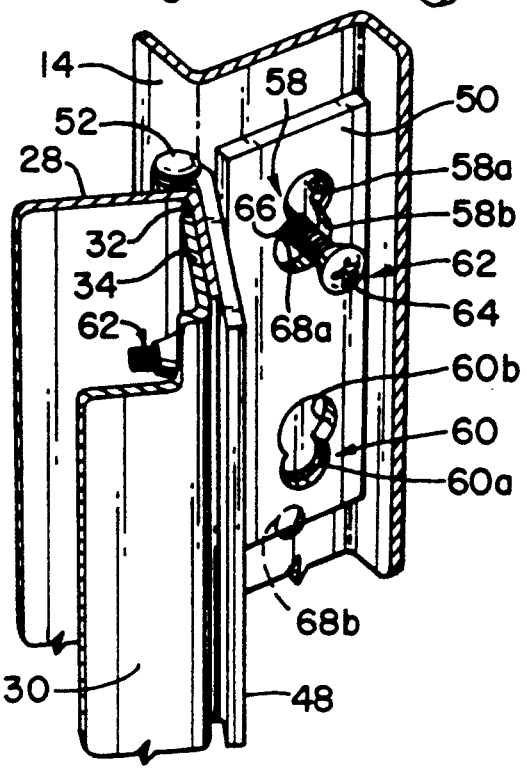
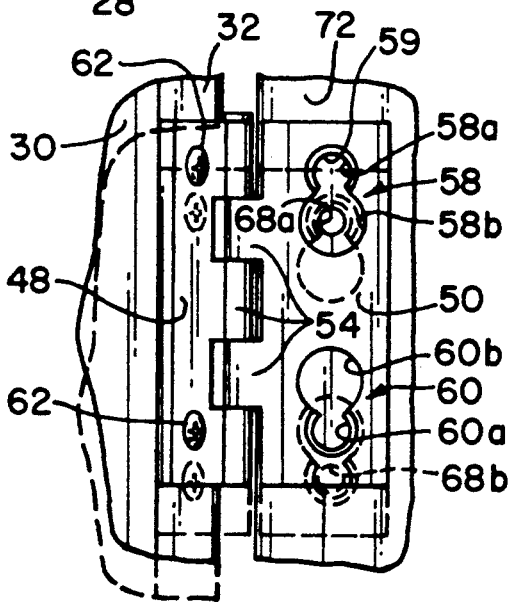
fig. 2

SELF-ALIGNING REVERSIBLE DOOR MOUNTING ARRANGEMENT FOR AN APPLIANCE

FIELD OF THE INVENTION

This invention relates generally to appliance door mounting arrangements and more particularly to a method for reversing the side to which an appliance door is mounted and to a door mounting arrangement for facilitating same.

BACKGROUND OF THE INVENTION

Appliances such as automatic clothes dryers typically have a cabinet with an opening in the front panel for accessing the interior of the dryer for loading and unloading the laundry. In the home, the dryer is often located next to a washing machine. Generally in such settings, it is desirable to have the dryer door hinged on the side of the access opening opposite the washer for convenience in moving the laundry from the washer to the dryer. However, whether the dryer is to the right or the left of the washing machine is often dictated by the location of pre-existing plumbing fixtures or electrical outlets or other structural considerations in the laundry area. Thus it is desirable to have a door mounting arrangement which allows the user to conveniently reverse the side to which the door is mounted to accommodate particular installation requirements.

U.S. Pat. No. 5,113,562 discloses a method for reversing the mounting side of a dryer door which is applicable to dryers in which the inner liner of the door is non-symmetrical, as is often the case. In this method, the hinges are disconnected from the front panel of the dryer cabinet to remove the door assembly from the cabinet. Next the inner liner is disengaged from the door and the door is inverted with respect to the liner. The liner is reengaged and the hinges are connected to the cabinet front panel on the opposite side of the opening. For dryers of the type having a symmetrical door, the steps associated with the removal of the inner liner could be eliminated.

Disconnection and connection of the hinges typically involves merely unscrewing and screwing the mounting screws attaching each hinge to the cabinet front panel. However, when re-connecting the door to the cabinet front panel, the door must be held in position with the screw holes in the hinge leaves aligned with the screw holes in the cabinet front panel so that the screws can be inserted through the leaves into the cabinet front panel. This can be an awkward task, particularly when done by hand by the servicer or the user in the home.

In one known arrangement employed for facilitating alignment of the screw holes during the initial assembly of dryers having non-symmetrical, non-reversible doors, the upper screw hole in each of the hinge leaves mounted to the cabinet are keyhole shaped. The reduced portion of each keyhole shaped hole is of lesser width than the diameter of the head of the mounting screw and projects upwardly from the enlarged portion which is of greater width than the diameter of the mounting screw head. The door is attached by first partially inserting the upper mounting screw for each hinge in the cabinet front panel, then aligning the door hinge leaves with the cabinet such that the enlarged portions of the keyholes line up with the mounting screws. The hinge leaves are positioned to allow the heads to pass through the enlarged portion of the keyholes. The door is then dropped downwardly until the upper edge of the reduced portion of the slots abuts the shank of the mounting screws. Attachment is completed by tightening the mounting screws.

Such an arrangement for aligning the screw holes works well for non-reversible door mounting arrangements. However, rotation of the hinge to reverse the door results in the keyhole slots being upside down. Therefore a need exists for a self-aligning hinge assembly applicable to reversible door mounting arrangements.

SUMMARY OF THE INVENTION

The present invention meets the need for a self-aligning hinge assembly applicable to reversible door mounting arrangements and provides a convenient method for reversing the door mounting side on an appliance such as a clothes dryer, to enable the user to selectively mount the appliance door to the appliance cabinet on the right or left side of the access opening for left-handed or right-handed opening, respectively. The door hinge assembly includes a fixed hinge leaf for attachment to the door and a detachable hinge leaf for attachment to the cabinet. The leaves are joined in conventional fashion by a hinge pin which passes through a bore formed by co-aligned knuckles formed along adjacent edges of the leaves. At least two mounting screws are provided for removably attaching each detachable leaf to the cabinet. The detachable hinge leaf has formed therein a pair of vertically aligned keyhole shaped openings, each opening having a reduced portion of lesser width than the diameter of the head of the mounting screws. Each reduced portion extends from an adjoining enlarged portion of sufficient width to permit the head of the mounting screw to pass through the enlarged opening. The reduced portion of the upper one of the pair of vertically aligned keyhole openings extends upwardly from the enlarged portion, and the reduced portion of the lower one of the keyhole opening extends downwardly from the enlarged portion of the opening.

A pair of vertically spaced openings for each hinge is provided along each side of the access opening to receive the mounting screws. The openings are spaced for registration with the reduced portions of the pair of keyhole openings in the detachable leaf. The detachable leaf is removably attached to the cabinet by the mounting screws which pass through the reduced portions of the keyhole openings into the corresponding pair of screw receiving openings in the cabinet for mounting the door to the right or left side of the access opening.

The provision of the keyhole openings in the detachable leaf, oriented as above described, facilitates a convenient method for reversing the mounting of the door. In accordance with this method, the mounting of the door is reversed from one side of the access opening to the other side, by first, removing the mounting screws attaching the detachable hinge leafs to the cabinet to disconnect the door from the cabinet. A mounting screw is then partially inserted in the upper opening for at least one of the pairs of openings at the other side of the access opening. The door is then inverted to generally align keyhole openings in the detachable hinges with the screw hole openings provided in the cabinet along the other side of the access opening. More specifically, the enlarged portion of the upper keyhole on the detachable hinge leaf is aligned with the corresponding partially inserted mounting screw. The detachable leaf is moved toward the mounting screw to permit the head to pass through the keyhole. The door is then moved downward until the upper edge of the reduced portion of the keyhole abuts the shank of the mounting screw. The reduced portion of the upper and lower keyholes are now aligned with the screw receiving openings in the cabinet. Reconnection of the door is completed by inserting screws in the remaining keyholes and tightening them in place.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings, in which:

FIG. 1 is a perspective view of a dryer with the door disconnected from the dryer cabinet but showing placement of the door in full lines for attachment to the left side of the dryer cabinet for right-hand opening and showing in phantom lines placement of the door, rotated 180 degrees relative to the full line representation, for attachment to the right side to the dryer cabinet for left-hand opening;

FIG. 2 is plan elevation view of a portion of the dryer of FIG. 1, more clearly showing the top hinge of the hinge assembly aligned for attaching the door to the cabinet in the dryer of FIG. 1 in a right-hand opening configuration; and FIG.3 is a perspective view of the portion of the dryer and door hinge assembly shown in FIG. 2.

DETAILED DESCRIPTION

Referring now to the drawings and in particular FIG. 1, there is shown an automatic clothes dryer 10 including a cabinet 12 with a front wall panel 14. An access opening 16 is formed in the front wall panel 14 for inserting and removing the clothes load to be dried. A clothes receiving drum 18 is mounted in the interior of the cabinet 12 for rotation about a horizontal axis in conventional fashion to tumble the clothes. An access door 20 is provided to close the access opening 16 to contain the clothes within the drum 18 during dryer operation. Various control knobs 22 and buttons 24 are provided on the control panel 26 to enable the user to select the appropriate operating cycle for the clothes load in conventional manner.

The access door 20 includes an outer panel 28 and an inner panel 30, each fabricated from sheet metal. The outer panel 28 is generally planar with an inwardly extending peripheral lip 32. A handle (not shown) may be mounted to the panel or integrally formed therein. The inner panel 30 has a corresponding outwardly extending peripheral lip 34 (FIG. 3). When assembled to the outer panel 28, the inner panel lip 34 closely fits within the outer panel lip 32 which overlaps it around the entire periphery of the door 20.

The surface of the inner panel 30 is contoured to form a generally peripherally extending embossment 36, which matches the shape of at least the lower portion of the access opening 16 such that when the door 20 is closed embossment 36 partially overlays the lower edge of the access opening 16 to prevent clothes from becoming caught. The inner panel 30 is further contoured to provide a depression 38 surrounded by the embossment 36, which increases the structural rigidity of the door 20 and which provides increased volume within the cabinet 12. It will be appreciated that the shape of the embossment 36 on the inner panel 30 is symmetrical. As will be hereinafter described in greater detail, this facilitates selectively reversing the door mounting arrangement for right or left-hand opening since the inner panel 30 can be rotated 180 degrees in the plane of the front wall panel 14 and fit properly in the access opening 16.

A generally rectangular recess 40 is formed in the front wall panel 14 surrounding the access opening 16 to receive the dryer door 20, such that when the door 20 is closed, the exterior surface of the outer door panel 28 is generally flush with the surface of the front wall panel 14 surrounding the recess 40. The dryer door 20 is pivotally attached to the front wall panel 14 by a hinge assembly 42, which includes a pair of leaf hinges 44 and 46. Each of hinges 44 and 46 includes a fixed hinge leaf 48 for attachment to the door 20 and a detachable hinge leaf 50 for attachment to the front wall panel 14. The leafs 48 and 50 are pivotally joined to each other by a hinge pin 52 which extends through coaxially aligned interleaved knuckles 54 formed along adjacent edges of each of leaves 48 and 50 in conventional fashion.

The fixed hinge leaves 48 are attached along the edge 56 of the door 20 by machine screws 62 which pass through the peripheral lips 32 and 34 of the inner and outer door panels 28 and 30 respectively, and the fixed leaf 48. (FIG. 3) Once the fixed hinge leaves 48 are attached to the door 20, they need not be removed to reverse the mounting of the door 20.

In accordance with the present invention, each detachable leaf 50 has formed therein a pair of vertically aligned keyhole shaped openings 58 and 60 for receiving mounting screws. Each of openings 58 and 60 has a reduced portion, **58*a* and 60*a* respectively, which extends from an enlarged portion, 58*b* and 60*b* respectively. The reduced portion 58*a* of the upper keyhole opening 58 (FIG. 3) extends upwardly from the enlarged portion 58*b* of the opening 58. The reduced portion 60*a* of the lower keyhole opening 60 (FIG. 3) extends in the opposite direction, downwardly from its enlarged portion 60*b*. Reduced portions 58*a* and 60*a* are of lesser width than the diameter of the head 64 of the mounting screw 62. Enlarged portions 58*b* and 60*b* are of width sufficient to enable the head 64 of the mounting screw 62 to pass through the opening. Preferably the width of the enlarged portion is greater than the diameter of the mounting screw head 64. The reduced portions 58*a* and 60*a* of the keyhole openings 58 and 60 are preferably slightly tapered or counter sunk openings to accommodate the taper of the head 64 of the mounting screw 62**.

In the illustrative embodiment mounting screws 62 are #8 machine screws. The nominal diameter of the screw head 64 is 0.261 inches, and the nominal diameter of the thread bearing shank 66 is 0.164 inches. The nominal diameters of the reduced and enlarged portions of each of the keyhole slots 58 and 60 are respectively 0.198 inches and 0.285 inches.

To facilitate the mounting of the door 20 to the front wall panel 14 proximate either side of the access opening 16, two pairs of vertically spaced mounting screw receiving openings 68 and 70 (FIG. 1) are formed in the front wall panel 14 for the upper one of hinges 44 and 46, in the shoulder 72 circumscribing the recess 40 in the front wall panel 14. One pair 68 is disposed along the right side of the door access opening 16 for mounting the door 20 to the right side of the door opening 16 for left-hand opening and the other pair 70 is disposed along the left hand side of the access opening 16 to mount the door 20 for right hand opening. The openings 68*a* and 68*b* and 70*a* and 70*b* in each of pairs 68 and 70 respectively, are vertically aligned and spaced for registration with the reduced portions 58*a* and 60*a* of the keyhole openings 58 and 60 respectively in the corresponding detachable hinge leaf 50. While only the upper pairs of openings 68 and 70 are visible in FIG. 1, it will be appreciated that a corresponding lower pair of openings is provided on each side of the access opening 16, similarly spaced for registration with the reduced portions 58*a* and 60*a* of the keyhole openings 58 and 60 in the detachable leaf 50 of the lower one of hinges 44 and 46.

As will become more apparent in the discussion of the method of reversing the door to follow, the provision of the keyhole shaped openings 58 and 60 in the detachable leaf 50 renders the reversible mounting arrangement self-aligning, thereby overcoming a deficiency in the prior art noted in the background discussion.

The door 20 is shown in full lines in FIG. 1, aligned for mounting to the left hand side of the access opening 16. As hereinbefore described the fixed leaf 48 for each of hinges 44 and 46 is attached to the door 20 by machine screws 62 and need not be subsequently removed when reversing the mounting of the door 20. To mount the door 20 on the left side of the access opening 16, hinges 44 and 46 are attached to the front wall panel 14 of the dryer cabinet 12 by partially inserting a mounting screw 62 into the upper screw hole opening 68*a* of the upper pair of openings 68 provided in the front wall panel 14 on the left side of the access opening 16. The door 20 is then positioned to align the upper keyhole opening 58 of the detachable hinge leaf 50 for upper hinge 44 to enable the head 64 of the partially inserted mounting screw 62 to pass through the enlarged portion 58*b* of the keyhole opening 58. Detachable leaf 50 is moved to the position shown in FIG. 3 with the mounting screw 62 projecting through the enlarged portion 58*b* of the keyhole opening 58. This positioning of leaf 50 of hinge 44 is also illustrated in FIG. 2 in full lines but with the screw 62 removed to better show the alignment of the openings. From this position the door 20 is dropped downward until the upper edge 59 of the reduced portion 58*a* of the keyhole opening 58 abuts the exposed shank 66 of the mounting screw 62. In this position the reduced portion 60*a* of the lower keyhole opening 60 in the upper hinge 44, as well as the reduced portions 58*a* and 60*a* of both keyhole openings 58 and 60 respectively, in the lower hinge 46 are aligned with the lower pair (not shown) of screw receiving openings in the front wall panel 14 on the left side of the access opening 16. This position of leaf 50 of hinge 44 is shown in phantom in FIG. 2 with the screw 62 removed for clarity of illustration. Mounting of the door 20 is completed by inserting mounting screws 62 through the remaining keyhole openings and tightening all four mounting screws.

The door 20 is reversed from the left side (in full in FIG. 1) to the right side of the access opening 16 to reverse the mounting arrangement in accordance with the reversing method of the present invention, by first disconnecting the door 20 from the cabinet 12 by removing the four mounting screws 62 securing the upper and lower detachable leafs 44 and 46 to the front wall panel 14 to the left side of the access opening 14. A mounting screw 62 is then partially inserted into the top screw receiving opening 70*a* on the right side of the access opening 14. The door 20 is re-aligned with the access opening 14 by inverting the door, such as by rotating it 180 degrees about its horizontal centerline (FIG. 1), to align the detachable leaves 50 of hinges 44 and 46 with the pairs of screw receiving openings on the right side of the access opening 14 (as shown in phantom in FIG. 1). After inverting the door 20, hinge 46 is the upper hinge and hinge 44 is the lower hinge. The enlarged portion 58*b* of the upper keyhole opening 58 in the detachable leaf 50 for upper hinge 46 is then aligned with the head 64 of the partially inserted mounting screw 62 and the detachable leaf 50 is moved to pass the head 64 of the screw 62 through the keyhole opening 58. With the mounting screw 62 projecting through the keyhole opening 58, the door 20 is moved downward until the upper edge 59 of the reduced portion 58*a* of the keyhole opening 58 abuts the shank 66 of the partially inserted mounting screw 62. In this position the detachable leaf 50 of door hinge 46 is aligned with the screw receiving openings 70 in front wall panel 14 such that reduced portion 60*a* of the lower keyhole opening 60 in the detachable leaf 50 of upper hinge 46 and both of the keyhole openings in the detachable leaf 50 of lower hinge 44 are aligned with the lower pair of screw receiving openings (not shown) in the front wall panel 14. Mounting is completed by completely inserting a mounting screw 62 in the reduced portion 60*a* of the lower keyhole opening 60 in the detachable hinge leaf 50 of the upper hinge 46 and tightening the upper mounting screw 62. Mounting screws 62 are then completely inserted through the keyhole openings in the detachable hinge 50 of the lower hinge 44.

In the foregoing description a single mounting screw 62 is initially partially inserted in the appropriate one of screw receiving openings 68 and 70 in the front wall panel 14 to pass through the upper keyhole 58 in the detachable leaf 50 for the upper one of hinges 44 and 46. However, it will be appreciated that alignment of the door 20 may be even more conveniently achieved by additionally initially partially inserting a second mounting screw 62 in the uppermost screw receiving opening for the lower one of hinges 44 and 46. Mounting of the door 20 then proceeds as above described except that detachable leaf 50 for each of hinges 44 and 46 is aligned to pass the enlarged portion 58*b* of the upper keyhole opening 58 over the corresponding one of the partially inserted mounting screws 62, before moving the door downward to receive the mounting screws 62 in the recessed portions 58*a* of the keyhole openings 58.

While a specific embodiment of the present invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

I claim:

1. In an appliance of the type having a cabinet including a wall with an access opening formed therein and a door for covering the opening attached to the wall by a door hinge assembly, an improved reversible self-aligning door mounting arrangement for selectively pivotally mounting the door to the cabinet for left-handed or right-handed opening including a fixed hinge leaf for attachment to the door and a detachable hinge leaf for attachment to the cabinet, and at least two mounting screws for removably attaching the detachable leaf to the cabinet wall, each screw comprising a head and a thread bearing shank extending therefrom, the improvement wherein:

the detachable hinge leaf has formed therein a pair of vertically aligned keyhole openings each opening having a reduced portion of lesser width than the diameter of said head of said mounting screws, and extending from an adjoining enlarged portion of width sufficient to permit said head of said mounting screws to pass therethrough, the reduced portion of the upper one of said vertically aligned keyhole openings extending upwardly from the enlarged portion of the opening, and the reduced portion of the lower one of said keyhole openings extending downwardly from the enlarged portion of the opening;

the cabinet wall having formed therein first and second pairs of vertically spaced openings relatively spaced for registration with said reduced portions of said keyhole openings in the detachable leaf to receive the mounting screws, said first pair being disposed along the right side of the door opening and said second pair being disposed along the left side of the door opening, the detachable leaf being removably attached to the cabinet wall by the mounting screws which pass through said reduced portions of said keyhole openings into said first or said second pair of screw receiving openings in the cabinet wall for mounting the door to the right or left side of the door opening, respectively, the door, when mounted to said right side for left-hand opening, being inverted relative to its position when mounted to the left side for right-hand opening.

2. The improvement of claim 1 wherein the appliance is a clothes dryer with the access opening in the front wall of the dryer cabinet.

3. For an appliance having a reversible door mounted to a wall of the appliance cabinet to cover an access opening therein, a door hinge assembly including at least one fixed hinge leaf for attachment to the door and a corresponding detachable hinge leaf for attachment to the appliance cabinet wall, a pair of mounting screws for attaching each detachable leaf to the cabinet wall; each detachable hinge leaf having formed therein a pair of vertically aligned keyhole openings, each opening having a reduced portion extending from an adjoining enlarged portion, the reduced portion of the upper one of the vertically aligned keyhole openings extending upwardly from the enlarged portion of the opening, and the reduced portion of the lower one of the keyhole openings extending downwardly from the enlarged portion of the opening; the cabinet wall having formed along opposite sides of the access opening, a first and a second pair, respectively, of vertically spaced openings for each detachable hinge leaf in register with the reduced portions of the keyhole openings in the detachable leaf, to receive the mounting screws, each detachable leaf being removably attached to the cabinet wall along the selected side of the access opening by the mounting screws which pass through said reduced portions of the keyhole openings into the corresponding ones of the first and second pairs of screw receiving openings in the cabinet wall, a method for reversing the selected side to which the appliance door is mounted comprising the following steps:

disconnecting the door from the cabinet by removing the mounting screws attaching each detachable hinge to the cabinet;

inserting a first one of the mounting screws part-way into the upper one of a pair of screw receiving openings on the newly selected side;

inverting the door to align the keyhole openings in each detachable leaf with the screw receiving openings on the newly selected side;

passing the enlarged portion of the uppermost keyhole opening in the corresponding detachable leaf over the head of the first partially inserted screw;

sliding the detachable leaf downwardly until the upper edge of the reduced portion of the keyhole opening abuts the shank of the screw;

driving a mounting screw through the reduced portion of the lower keyhole into the lower screw receiving opening until tight; and tightening the first mounting screw.

4. For an automatic clothes dryer of the type having a reversible door for the clothes receiving opening, pivotally mounted to the front wall of the dryer by a pair of door hinges, each hinge including a fixed hinge leaf for attachment to the door and a corresponding detachable hinge leaf for attachment to the front wall of the dryer, a pair of mounting screws for attaching each detachable leaf to the dryer front wall, each detachable hinge leaf having formed therein a pair of vertically aligned keyhole openings, each opening having a reduced portion extending from an adjoining enlarged portion, the reduced portion of the upper one of the vertically aligned keyhole openings extending upwardly from the enlarged portion of the opening, and the reduced portion of the lower one of the keyhole openings extending downwardly from the enlarged portion of the opening; the front wall having formed therein along first and second opposite sides of the clothes receiving opening, a first and a second pair, respectively, of vertically spaced openings for each detachable hinge leaf to receive the mounting screws, the openings in each pair being relatively spaced to be in register with the reduced portions of the keyhole openings in the detachable leaf when the door is properly aligned in the opening for mounting to the first or second side respectively, each detachable leaf being removably attached to the front wall along the selected side of the clothes receiving opening by the mounting screws which pass through the reduced portions of the keyhole openings into the corresponding ones of the first and second pairs of screw receiving openings in the front wall, a method for reversing the mounting of the appliance door comprising the following steps:

disconnecting the door from the front wall by removing the mounting screws attaching each detachable hinge leaf thereto;

driving a first one of the mounting screws part-way into the upper one of at least one of the pairs of screw receiving openings on the newly selected side;

inverting the door to approximately align the keyhole openings in each detachable leaf with the screw receiving openings on the newly selected side of the opening;

passing the enlarged portion of the uppermost keyhole opening in the corresponding detachable leaf over the head of the first partially inserted mounting screw;

sliding the door downwardly until the upper edge of the reduced portion of the keyhole opening abuts the shank of the partially inserted mounting screw;

driving a mounting screw through the reduced portion of the lower keyhole into the lower screw receiving opening until tight; and tightening the first mounting screw.

* * * * *